US008590626B2

(12) United States Patent
Barone et al.

(10) Patent No.: US 8,590,626 B2
(45) **Date of Patent: *Nov. 26, 2013**

(54) OFFSHORE WELL INTERVENTION LIFT FRAME AND METHOD

(75) Inventors: Vincent H. Barone, Huffman, TX (US); Trevor S. Brown, Houston, TX (US)

(73) Assignee: Stingray Offshore Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/443,638

(22) Filed: Apr. 10, 2012

(65) Prior Publication Data

US 2012/0227976 A1 Sep. 13, 2012

Related U.S. Application Data

(63) Continuation of application No. 12/548,886, filed on Aug. 27, 2009, now Pat. No. 8,162,062.

(60) Provisional application No. 61/092,565, filed on Aug. 28, 2008.

(51) Int. Cl.
*E21B 19/00* (2006.01)

(52) U.S. Cl.
USPC ..... 166/355; 166/345; 166/77.1; 166/85.1; 166/75.14; 405/224.4

(58) Field of Classification Search
USPC ..... 166/355, 339, 344, 345, 351, 352, 367, 166/368, 77.1, 77.2, 77.51, 85.1, 75.14; 405/195.1, 224, 224.2–224.4
See application file for complete search history.

(56) References Cited

U.S. PATENT DOCUMENTS

| | | | | | |
|---|---|---|---|---|---|
| 3,718,316 | A * | 2/1973 | Larralde et al. | 254/277 |
| 3,785,445 | A * | 1/1974 | Scozzafava | 175/5 |
| 3,834,672 | A * | 9/1974 | Hawley et al. | 254/392 |
| RE28,218 | E * | 10/1974 | Hanes et al. | 175/5 |
| 3,949,883 | A * | 4/1976 | Crooke et al. | 414/745.2 |
| 4,176,722 | A * | 12/1979 | Wetmore et al. | 175/7 |
| 4,535,972 | A * | 8/1985 | Millheim et al. | 254/277 |
| 4,585,213 | A * | 4/1986 | Slagle et al. | 254/388 |
| 4,694,909 | A * | 9/1987 | Stephenson et al. | 166/356 |
| 4,858,694 | A * | 8/1989 | Johnson et al. | 166/355 |
| 5,163,783 | A * | 11/1992 | Fahrmeier et al. | 405/195.1 |
| 6,000,480 | A * | 12/1999 | Eik | 175/8 |
| 6,095,501 | A * | 8/2000 | Vatne | 254/385 |
| 6,343,893 | B1 * | 2/2002 | Gleditsch | 405/196 |
| 6,470,969 | B1 * | 10/2002 | Sørhaug et al. | 166/355 |
| 6,708,765 | B1 * | 3/2004 | Eilertsen | 166/350 |
| 6,752,213 | B1 * | 6/2004 | van der Poel | 166/355 |
| 6,929,071 | B2 * | 8/2005 | Moncus et al. | 166/355 |
| 6,968,900 | B2 * | 11/2005 | Williams et al. | 166/355 |
| 7,063,159 | B2 * | 6/2006 | Patton et al. | 166/355 |
| 7,096,963 | B2 * | 8/2006 | Moncus et al. | 166/381 |
| 7,131,496 | B2 * | 11/2006 | Williams et al. | 166/355 |

(Continued)

*Primary Examiner* — Matthew Buck
(74) *Attorney, Agent, or Firm* — Haynes and Boone, LLP

(57) ABSTRACT

An improved motion compensator device that includes a compensated framework for various types of well intervention operations where a stable work area is required that is stationary to the sea bed and equipment in the annulus. The device is intended for use on offshore drilling vessels that are primarily either moored or dynamically positioned and therefore subject to the motions created by the sea. The device is designed to compensate for the vertical motion of the rig by means of two steel frame assemblies, pneumatic compensating cylinders, and a load and motion transfer apparatus.

29 Claims, 6 Drawing Sheets

(56) References Cited

U.S. PATENT DOCUMENTS

| | | | | |
|---|---|---|---|---|
| 7,163,061 | B2 * | 1/2007 | Moncus et al. | 166/355 |
| 7,191,837 | B2 * | 3/2007 | Coles | 166/355 |
| 7,219,739 | B2 * | 5/2007 | Robichaux | 166/355 |
| 7,231,981 | B2 * | 6/2007 | Moe et al. | 166/355 |
| 7,306,404 | B2 * | 12/2007 | Torgersen | 405/224.4 |
| 7,314,087 | B2 * | 1/2008 | Robichaux | 166/355 |
| 7,329,070 | B1 * | 2/2008 | Trent et al. | 405/224.4 |
| 7,360,589 | B2 * | 4/2008 | Moncus et al. | 166/77.51 |
| 7,404,443 | B2 * | 7/2008 | Patton et al. | 166/355 |
| 7,530,399 | B2 * | 5/2009 | Dreelan | 166/355 |
| 7,784,546 | B2 * | 8/2010 | Patton | 166/355 |
| 7,878,735 | B2 * | 2/2011 | Roodenburg et al. | 405/170 |
| 2004/0099421 | A1 * | 5/2004 | Trewhella | 166/355 |
| 2005/0103500 | A1 * | 5/2005 | Trewhella | 166/355 |
| 2007/0089884 | A1 * | 4/2007 | Patton | 166/355 |
| 2008/0099208 | A1 * | 5/2008 | Moncus et al. | 166/338 |

* cited by examiner

OFFSHORE WELL INTERVENTION LIFT FRAME AND METHOD

CROSS-REFERENCE TO RELATED APPLICATIONS

This application is a continuation of and claims benefit to U.S. patent application Ser. No. 12/548,886, filed Aug. 27, 2009, issued as U.S. Pat. No. 8,162,062, entitled "OFFSHORE WELL INTERVENTION LIFT FRAME AND METHOD," also naming Vincent H. Barone and Trevor S. Brown as inventors, which is a non-provisional of U.S. provisional application No. 61/092,565, filed Aug. 28, 2009, each of which is hereby incorporated by reference in their entirety.

FIELD OF THE INVENTION

The present invention relates to an offshore well intervention lift frame and method capable of compensating for the vertical motion of offshore floating or tension leg platforms.

BACKGROUND OF THE INVENTION

Motion compensator devices have been developed to counteract the motion of offshore floating and tension leg platforms during well intervention procedures. For example, U.S. Pat. No. 6,929,071 is drawn to a motion compensator system and method which includes a frame member positioned on a platform, a deck slidably attached via guide posts to the frame member, (the deck being attached to the riser), and a pressure cylinder and piston assembly which moves the frame relative to the deck. U.S. Pat. No. 7,063,159 is drawn to a coiled tubing handling system that includes a lifting frame, a load compensation system, and a flexible riser system that reduces the load on the wellhead and permits horizontal and vertical movement between the BOPs, coiled tubing stack, and wellhead. U.S. Published Patent Application No. 2008/0099208 A1 is drawn to an apparatus for performing well work on a floating platform which includes a frame assembly, a crown section assembly, a motion compensator means, and a travel head connected to the motion compensator means and to a well intervention device. U.S. Pat. Nos. 6,929,071 and 7,063,159, as well as U.S. Published Patent Application No. 2008/0099208 A1, are each incorporated by reference herein.

SUMMARY OF THE INVENTION

The present invention is an improved motion compensator device that includes a compensated framework for various types of well intervention operations where a stable work area is required that is stationary to the sea bed and equipment in the annulus. The device is intended for use on offshore drilling vessels that are primarily either moored or dynamically positioned and therefore subject to the motions created by the sea. The device is designed to compensate for the vertical motion of the rig by means of two steel frame assemblies, pneumatic compensating cylinders, and a load and motion transfer apparatus.

An embodiment of a motion compensating apparatus of the present invention may include an outer frame having an upper section for attachment to an elevator assembly of an offshore drilling or production rig floating on a surface of a body of water. The apparatus may also include an inner frame in sliding cooperation with the outer frame. The apparatus may have a plurality of compensation cylinders operatively associated with the outer frame and detachably affixed to the inner frame. The apparatus may also contain a capturing assembly detachably connected to the inner frame. The capturing assembly may be capable of supporting well intervention equipment connected to a well. In the apparatus, the plurality of compensation cylinders may be activated to an extended or retracted position to maintain the vertical position of the well intervention equipment despite the rise or fall of the surface of the body of water.

The outer frame of the apparatus may have an inverted U-shape with two opposing side walls. The outer frame may have an outer surface and an inner surface. The outer surface of said outer frame includes a lift sub for connection by said elevator assembly. The inner frame of the apparatus may have an inverted U-shape with two opposing side legs. The inner frame may be positioned adjacent to the inner surface of the outer frame and be in sliding cooperation therewith. The side walls of the outer frame may contain or house a portion of the plurality of compensation cylinders.

The outer frame of the apparatus may include means for restricting the complete retraction of the plurality of compensation cylinders. The means may comprise one or more safety pins.

In the apparatus, the plurality of compensation cylinders may have a distal end and a proximal end. The distal end of the cylinders may be detachably affixed to one of the side legs of the inner frame.

The apparatus may contain means for activating said compensation cylinders. The means may comprise a plurality of conduits for transmitting pneumatic fluid to the cylinders.

The capturing assembly of the apparatus may be capable of articulation about the point of attachment with the inner frame. The apparatus may be provided with means for preventing articulation of the capturing assembly. The means may comprise one or more anti-rotation pins connecting the inner frame to the capturing assembly. The capturing assembly may include a retaining door having an adjustable opening for placement and support of a lift joint for the well intervention equipment. The retaining door may be hydraulically actuated to open the adjustable opening to receive or release the lift joint or hydraulically activated to close the adjustable opening to grip and support the lift joint and the well intervention equipment attached thereto. The capturing assembly may also include one or more hydraulically actuated bail pins for supporting a bail.

Another embodiment of the motion compensating apparatus of the present invention may include an inverted U-shaped outer frame with opposing side walls. The outer frame may include a central lift sub prong for attachment by an elevator assembly of an offshore drilling or production rig floating on a surface of a body of water. The apparatus may also include an inverted U-shaped inner frame with opposing side legs. The inner frame may be in sliding cooperation with the outer frame. The apparatus may further contain two pairs of compensation cylinders operatively associated with the outer frame. Each cylinder may have a proximal end and a distal end. The proximal ends of one of the pairs of cylinders may be housed within one of the side walls of the outer frame and the distal ends of the pair of cylinders may be detachably affixed to one of the legs of the inner frame. The proximal ends of the other pair of cylinders may be housed within the other side wall of the outer frame and the distal ends of the pair of cylinders may be detachably affixed to the other leg of the inner frame. The apparatus may also include a plurality of conduits in fluid communication with the two pairs of compensation cylinders. The apparatus may further contain a capturing assembly detachably connected to the legs of the inner frame. The capturing assembly may have a movable collar for gripping and releasing a lift joint for fixation to well intervention equipment connected to a well. The pairs of compensation cylinders may be activated by pneumatic fluid passing through the plurality of conduits to an extended or retracted position to maintain the vertical position of the well intervention equipment despite the rise or fall of the surface of the body of water.

The alternative embodiment of the apparatus may include means for detachably locking said inner frame to said outer frame. The means may comprise a hydraulically actuated locking pin.

The alternative apparatus may also include a control panel operatively connected to the apparatus for operating the apparatus.

The present invention also is directed to a method of maintaining the vertical position of well intervention equipment connected to a well. The method comprises the step of providing a motion compensating apparatus comprising: an outer frame having an upper section for attachment to an elevator assembly of an offshore drilling or production rig floating on a surface of a body of water; an inner frame in sliding cooperation with the outer frame; a plurality of compensation cylinders operatively associated with the outer frame and detachably affixed to the inner frame; a capturing assembly detachably connected to the inner frame, the capturing assembly capable of supporting said well intervention equipment connected to said well. The method may include the step of attaching an elevator assembly to the apparatus and lifting the apparatus upward within a derrick of the rig. The method may also include the step of causing the capturing assembly to grip and support a lift joint. The method may include the step of attaching the lift joint to the well intervention equipment. The method may also include the step of maintaining the vertical position of the well intervention equipment by activating the plurality of compensation cylinders to either an extended or retracted position depending on the rise or fall of the surface of the body of water.

The apparatus used in the method may further include a winch or hoist positioned on the inner frame. The method may include the step of using the winch or hoist to position the well intervention equipment in the capturing assembly.

DETAILED DESCRIPTION OF THE PREFERRED EMBODIMENTS

Figure 1:
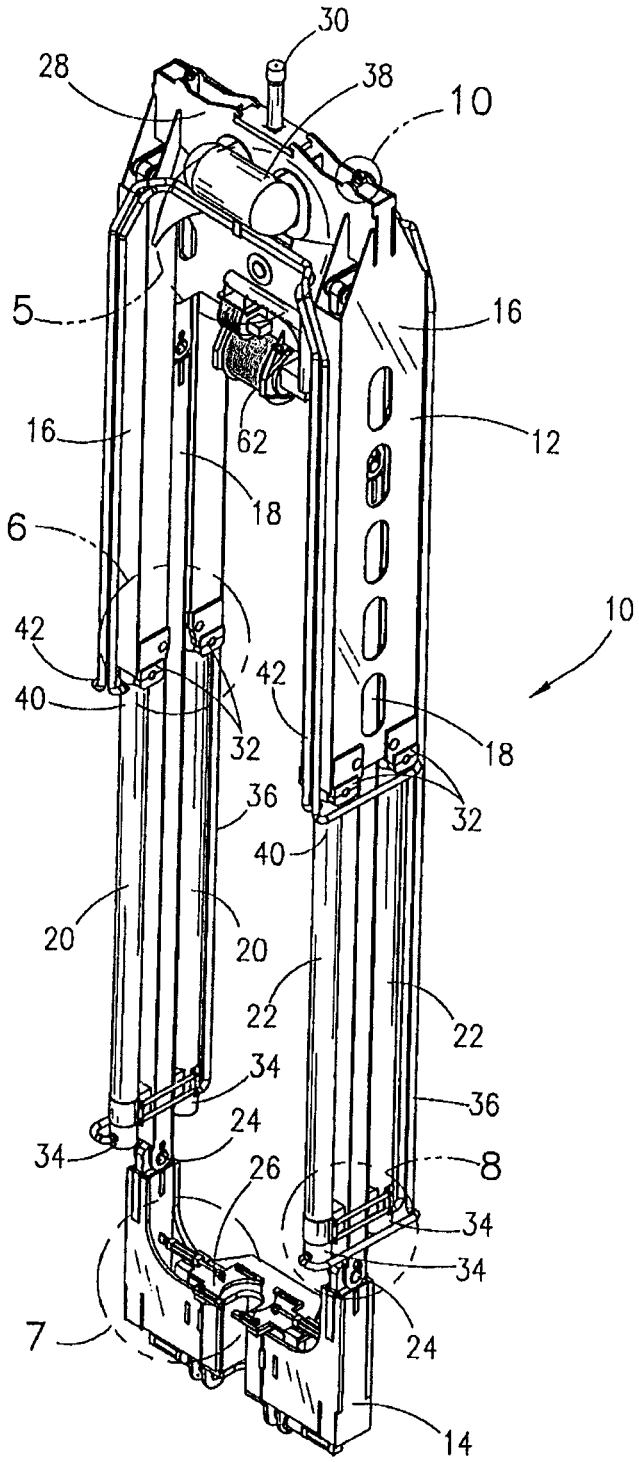
FIG. 1 is a perspective view of an embodiment of the lift frame of the present invention in retracted position.
Figure 2:
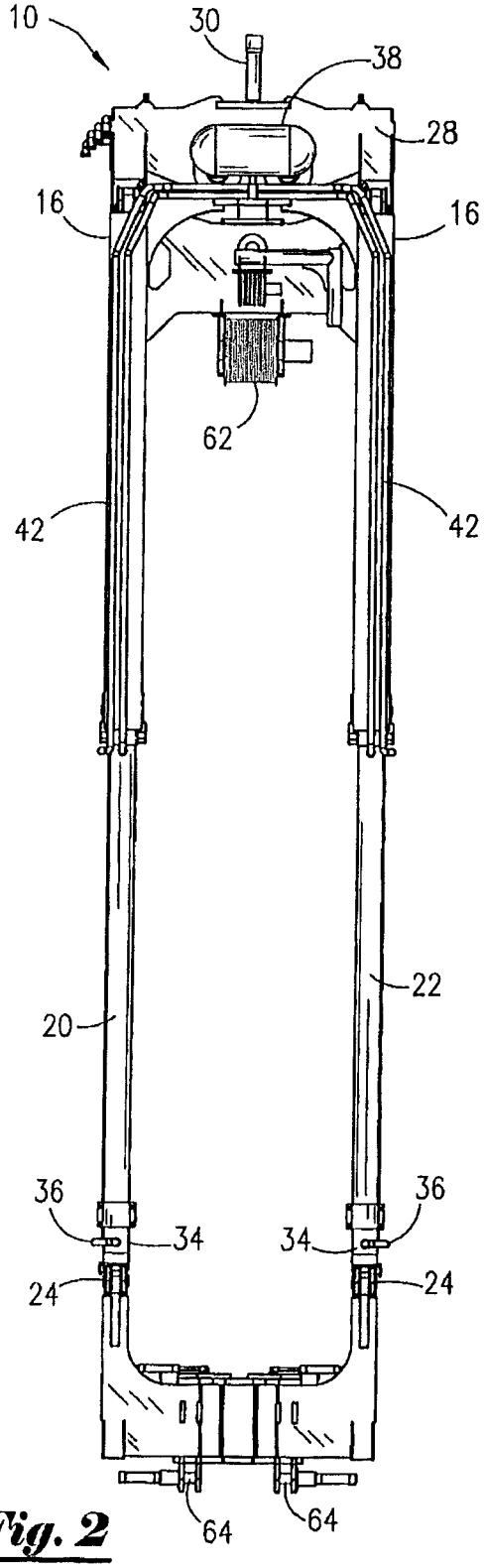
FIG. 2 is a front view of the embodiment of the lift frame of FIG. 1.
Figure 3:
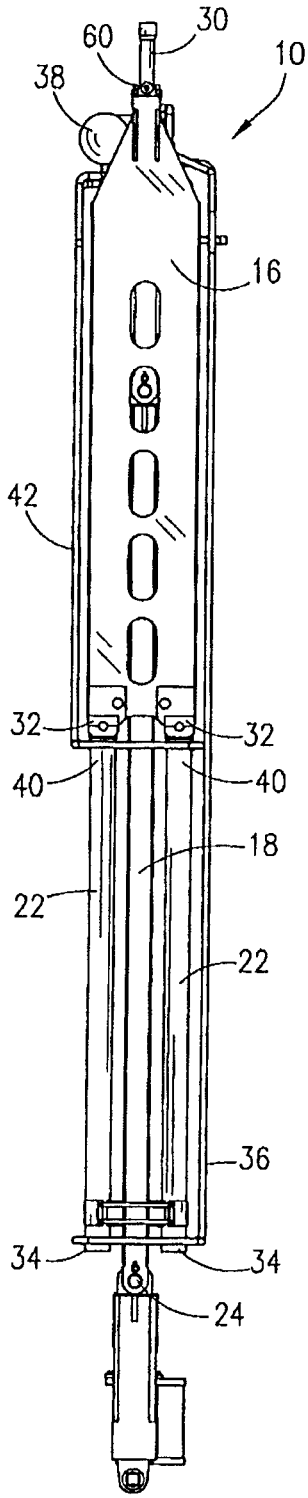
FIG. 3 is a side view of the embodiment of the lift frame of FIG. 1.

With reference to the figures where like elements have been given like numerical designation to facilitate an understanding of the present invention, and in particular with reference to the embodiment of the present invention illustrated in FIG. 1, motion compensator device 10. Device 10 is shown in a retracted position. Device 10 consists of upper section 12 and lower section 14. Upper section 12 includes outer frame 16 and slidable inner frame 18. Both outer and inner frames 16, 18 may be substantially U-shaped or more particularly, inverted U-shaped. Upper section 12 also includes two pairs of compensating cylinders 20 and 22. Compensating cylinders 20, 22 are operatively connected to outer frame 16 and slidable inner frame 18. Compensating cylinders 20, 22 are also known as pistons. Outer frame 16 allows for the attachment, travel, and guidance of compensating cylinders 20 and 22 that provide the force necessary for compensation of device 10.

With reference again to FIG. 1, upper section 12 and lower section 14 are shown operatively connected. Upper section 12 and lower section 14 may be pinned together via pins 24 to allow for articulation or separation of the sections for either the addition of leg extensions or to assist in the installation of device 10 into a drilling rig derrick. Lower section 14 is designed to support and capture equipment connected to the sea bed. Lower section 14 may be a support/capture system, which includes door device 26 actuated via remote hydraulics or offset attachment points using remote hydraulics for the operation where such equipment such as bails can be attached.

FIG. 1 shows that upper section 28 of outer frame 16 may include central lift sub attachment point 30, which directly connects to the rig's elevator system to suspend device 10 above the platform of the rig.

Figure 6:
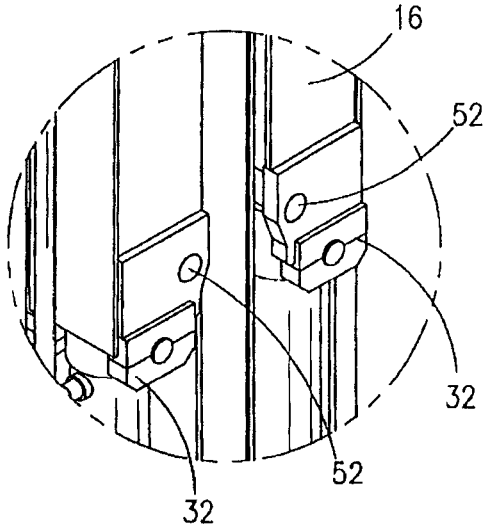
FIG. 6 is a perspective view of area "6" of FIG. 1 illustrating the front trunion mount of a cylinder and safety pins that prevent bottoming out of cylinders.
Figure 7:
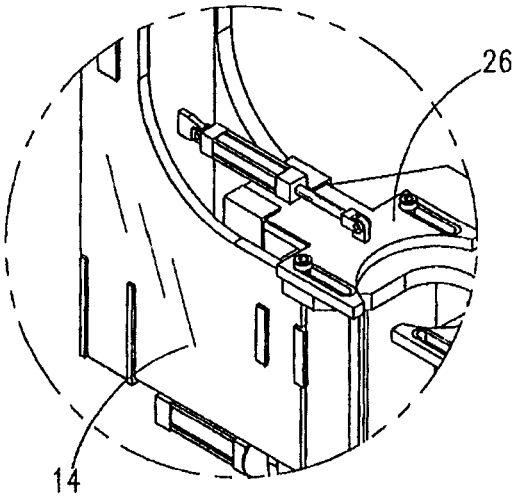
FIG. 7 is a perspective view of area "7" of FIG. 1 illustrating a hydraulically activated tubular retaining door.

As seen in FIGS. 1 and 6, outer frame 16 may use fixed trunions 32 that attach to the barrel of compensation cylinders 20, 22 mounted on the lower frame to transfer the motion. There are also fixed points on outer frame 16 for cylinders 20, 22 to react against so that cylinders 20, 22 can apply the force necessary to support the given loads during well intervention.

The total energy for device 10 may be provided by the use of compressed gas on blind end 34 of cylinders 20, 22 via conduits 36. Under normal circumstances, compressed air is used. But, compressed nitrogen can also be used. A number of deck-mounted air pressure vessels may be used to increase the volume in order to reduce variance in the compensating force. While compressed gas is preferably used to operate compensating cylinders 20, 22, it is to be understood that hydraulic fluid could also be used.

Figure 5:
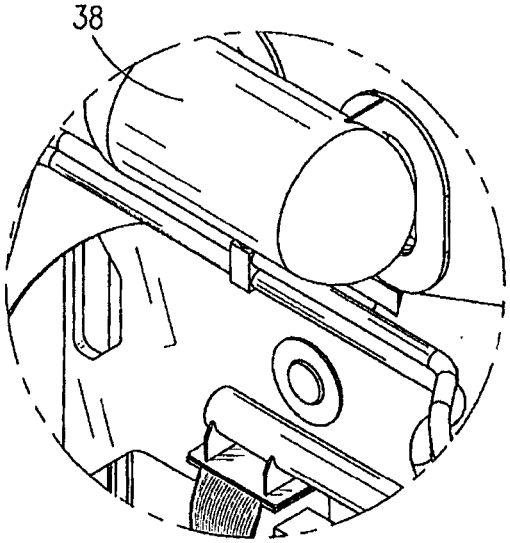
FIG. 5 is a perspective view of area "5" of FIG. 1 illustrating a jib arm with winch and air/oil reservoir.

With reference to FIGS. 1 and 5, device 10 includes small air/oil reservoir 38 on rod side 40 of compensating cylinders 20, 22 to act as a lubricant, which travels to cylinders 20, 22 via conduits 42. In case of either a catastrophic or accidental separation of the intervention string, speed control valves will limit the travel velocity as compensating cylinders 20 22 extend.

Figure 8:
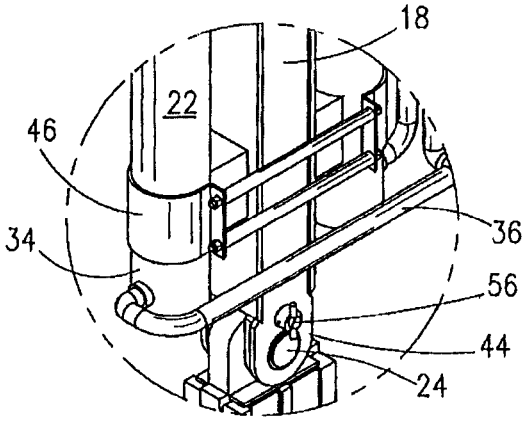
FIG. 8 is a perspective view of area "8" of FIG. 1 illustrating cylinder guide brackets and anti-rotation pins.

FIG. 8 shows that blind end 34 of cylinders 20, 22 are also detachably affixed to lower end 44 of slidable inner frame 18 via cylinder guide brackets 46.

Figure 4A:
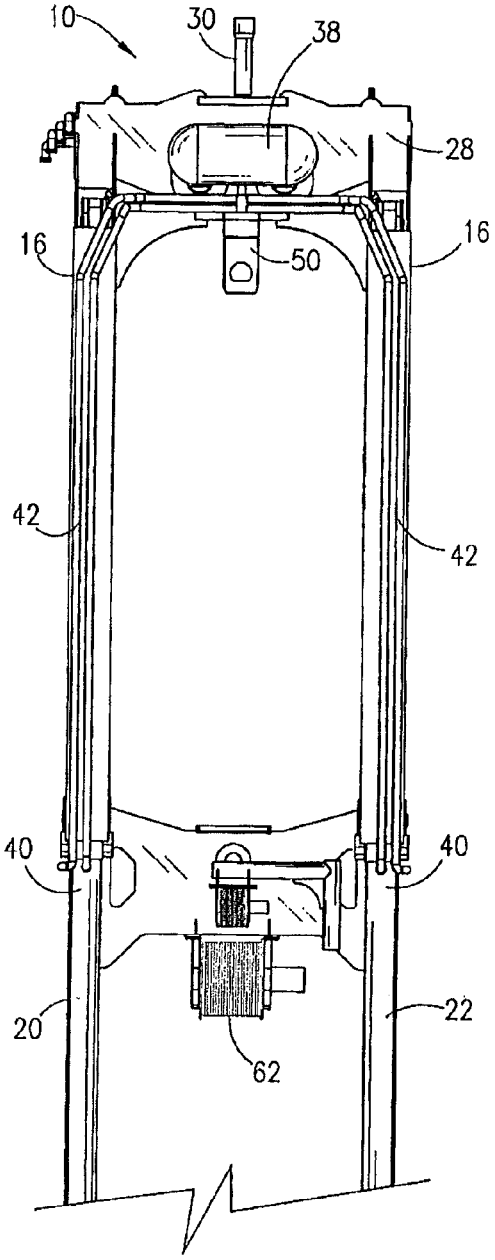
FIGS. 4A and 4B are a sequential front view of an embodiment of the lift frame of the present invention in extended position.
Figure 9:
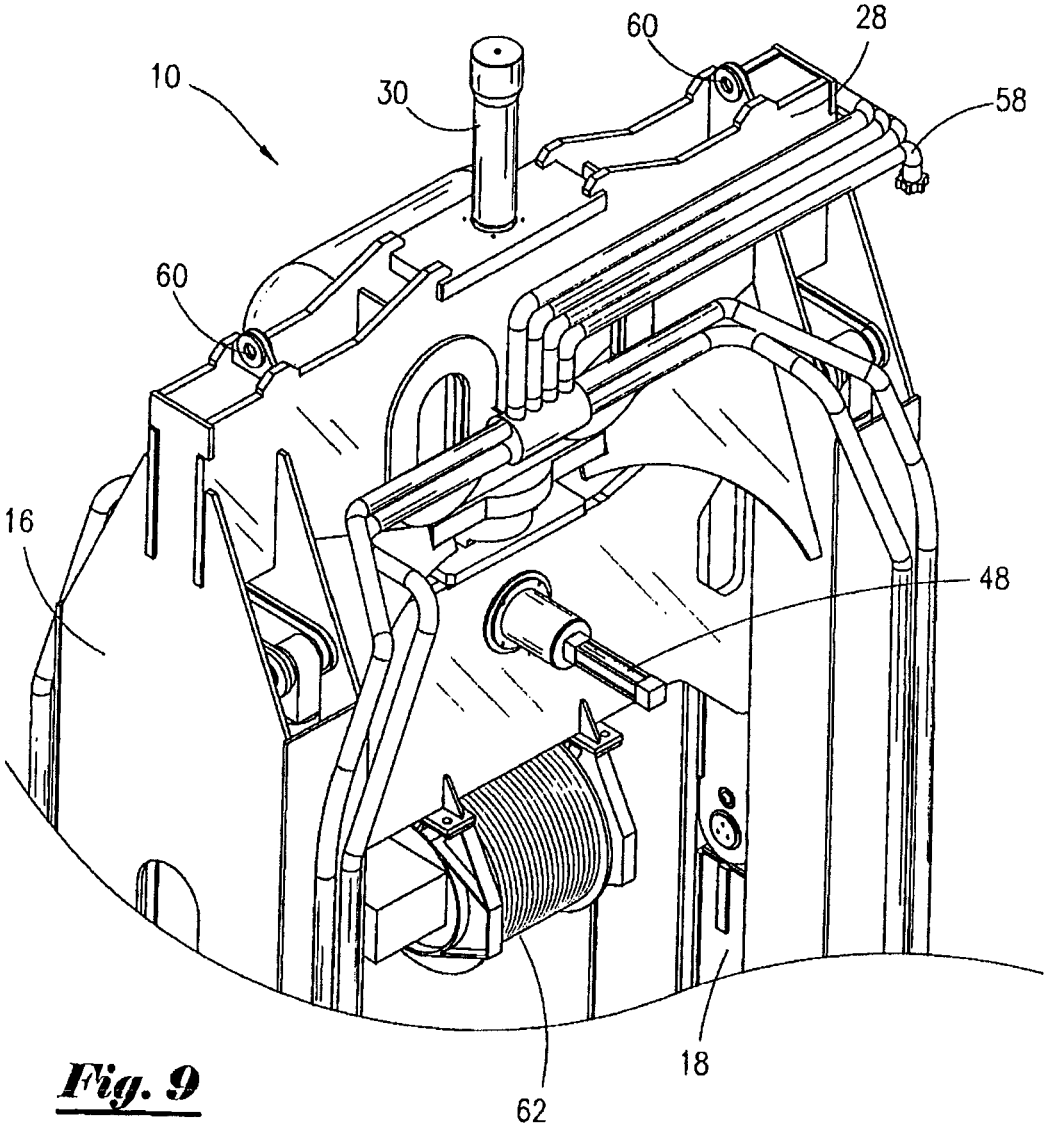
FIG. 9 is a partial perspective view of the backside of the upper section of an embodiment of the lift frame of the present invention.

With reference to FIG. 9, device 10, and in particular, outer and inner frames 16, 18, may mechanically lock together in a closed position by means of a hydraulically operated pin 48. Pin 48 is positioned on slidable inner frame 18. When locked, pin 48 extend through locking bracket 50 on outer frame 16 as seen in FIG. 4A; device 10 no longer compensates but has increased load bearing capacity making it possible for the installation, removal, and transportation of the unit.

Device 10 may include fixed mechanical stops that will allow the travel of the unit to stop prior to full retraction of cylinders 20, 22. As seen in FIG. 6, outer frame 16 includes safety pins 52 that prevent the bottoming out of cylinders 20, 22.

As illustrated in FIGS. 1 and 8, articulation of lower section 14 may be controlled by a four pin system. Two large pins 24 carry the main load and allow for rotation of lower section 14. Two small anti-rotation pins 56, when in place, prevent the rotation of lower section 14, but when removed, allow the rotation of lower section 14. Lower section 14 may be two individual sub-sections that when installed are held to one another.

Multiple hoses may be used to carry air pressure from the main air pressure vessels to device 10 when mounted in the derrick. As seen in FIG. 9, gooseneck conduits 58 provide a connection means for the multiple hoses. Multiple hoses allow for redundancy in case of hose failure. Should such failure occur, each hose uses manual isolation valves at each end so they may be isolated from the system and still allow device 10 to operate.

Figure 10:
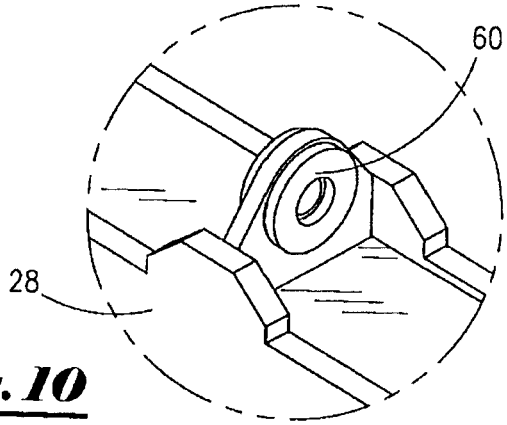
FIG. 10 is a perspective view of area "10" of FIG. 1 illustrating the upper handling padeyes.

Device 10 may contain multiple lifting points installed thereon for assistance in handling. For example, FIGS. 9 and 10 show padeyes 60 on upper section 28 of outer frame 16. Padeyes 60 serve at attachment points for rig hoist equipment.

Device 10 may be made of high strength steel, which reduces the weight of the system. As seen in FIGS. 1 and 9, device 10 may contain overhead winch 62. Winch 62 may be affixed to slidable inner frame 18. Winch 62 may be used to assist in installing well intervention equipment into lower section 14.

The installation of device 10 will now be described. First, install elevators in the derrick to accept lift sub 30 of device 10. Position the elevators at an elevation for that purpose. Move device 10 to the area in front of the V-door or on the cat-walk of the rig. Optionally remove two small anti-rotation pins 56 securing lower section 14 that prevent its articulation or rotation. By removing pins 56, device 10, and more particularly, lower section 14, is permitted to articulate as it is pulled into the derrick. Alternatively, pins 56 could be left in place so that device 10 can be lifted by the elevator as one unit. If pins 56 are removed, it is important to re-insert them after device 10 is suspended in the derrick. Install the elevators around lift sub 30 in upper section 28 of outer frame 16 when it reaches the center of the rotary. Attach stabilizing lines to the bottom of device 10 to control it as it hoisted into the derrick. Attach the main air lines and the smaller hydraulic control lines via gooseneck conduits 58. Charge device 10 with the minimum air required for operation. Unlock slidable inner frame 18 from outer frame 16 by releasing locking pin 48. Device 10 will remain in its retracted position until compensation to account for the rise or fall of the sea level.

Device 10 may be configured for attachment of bails. For using the bail point attachment, retract link pins 64 and bushing at the bottom lower section 14. Install links into the bottom of section 14 by putting the links in section 14 and re-extending pins 64. Hoist up device 10 until the links are free of the rig floor. Lower device 10 down to the riser and attach to the links.

For using the center capture system 18, unlock and open the center gate or door 26. Install a lift joint into the open "U" slot of system 18. Close and lock the center gate or door 26. Hoist device 10 using the elevators until the unit is mid position in the derrick or to the required position for operation. Device 10 is now ready to have well intervention equipment installed via the lift joint. Winch 62 may be used to position the well intervention equipment in device 10. Winch 62 may have a 33K capacity. Winch 62 is commercially available from Lantec under model name LHS330-01.

Figure 11:
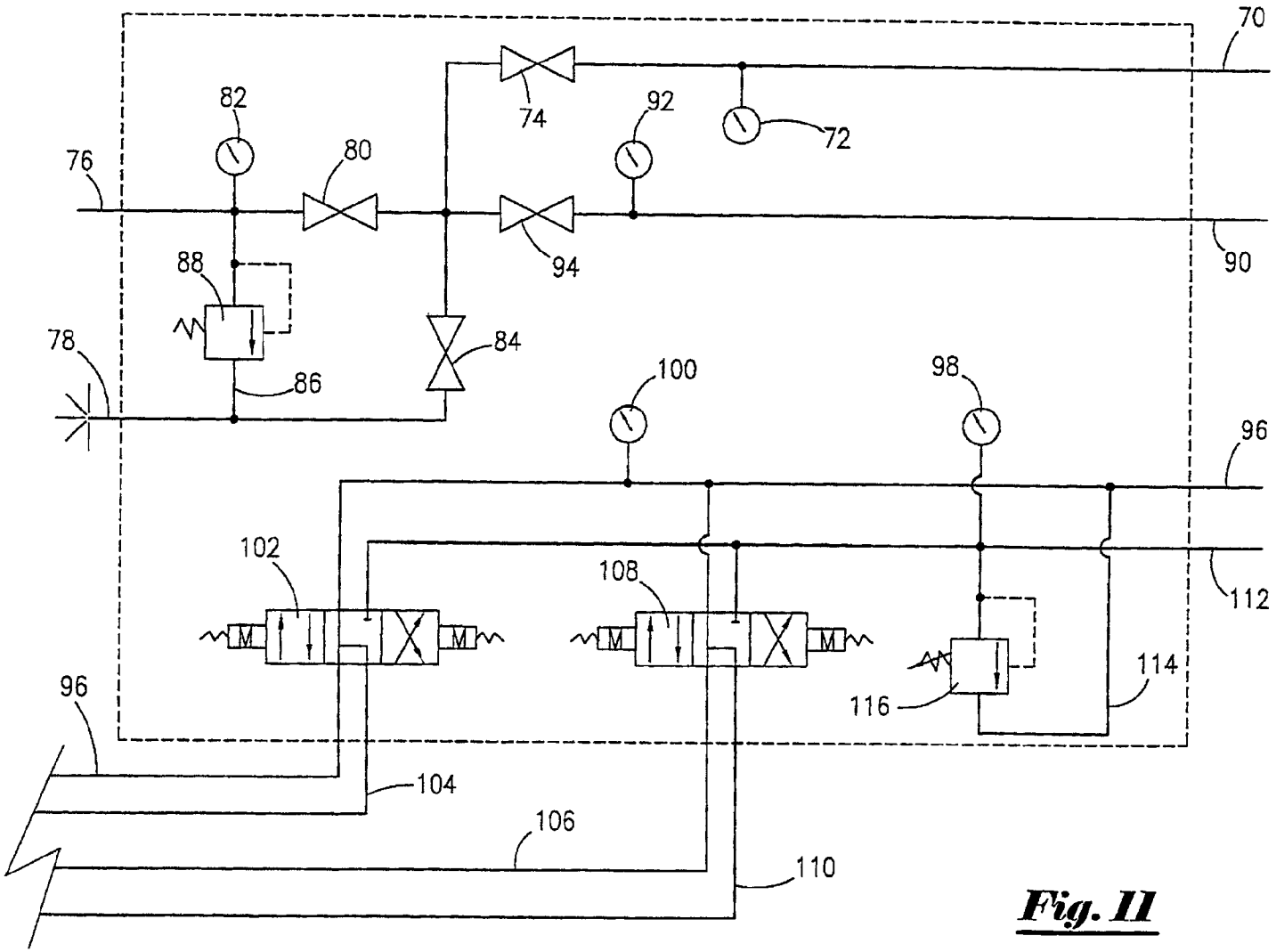
FIG. 11 is a schematic representation of a control panel for operation of an embodiment of the lift frame of the present invention.

FIG. 11 is a schematic of the control panel that is used to operate device 10. Line 70 provides passage of fluid (e.g., compressed gas) from standby bottles to device 10. Pressure gauge 72 is provided in line 70 and measures pressure from 0 to 5,000 psi. Valve 74 is provided in line 70. Valve 74 may be a ball valve (1½"×3000 psi wp). Line 70 splits into line 76 which powers compensation cylinders 20, 22 and line 78 which vents to the atmosphere. Line 76 includes valve 80, which may be a ball valve (1½"×3000 psi wp). Line 76 also includes pressure gauge 82 with tension indication 0-3000 psi. Line 78 includes valve 84 which may be a ball valve (1½"×3000 psi wp). Line 86 interconnects lines 76 and 78 and includes relief valve 88 which may be set at 2350 psi. Line 90 provides passage of fluid (e.g., compressed gas) from the rig to device 10. Line 90 includes pressure gauge 92 that measure pressure from 0 to 5,000 psi and valve 94, which may be a ball valve (1½"×3000 psi wp). Line 90 splits into line or connects to lines lines 76 and 78. All lines may be 1½"×3000 psi.

Again with reference to FIG. 11, line 96 provides for the passage of hydraulic fluid (3000 psi wp) from the rig hydraulic pressure unit to device 10 to lock or unlock lock pin 48. Line 96 includes two pressure gauges 98, 100, which may measure up to 6000 psi. Line 96 includes valve 102, which may be a spring center valve (3 pos-4 way ¾"×3000 psi). Line 96 runs from valve 102 to activate lock pin 48 into a locked position. Valve 102 may divert the fluid from line 96 through line 104 to activate lock pin 48 into an unlocked position. Line 106 runs from line 96 to valve 108. Valve 108 may be a spring center valve (3 pos-4 way ¾"×3000 psi). Line 106 runs from valve 108 to cause the extension of bail pins 64. Valve 108 may divert fluid from line 106 to line 110 to cause the retraction of bail pins 64. Line 112 is provided for the return of fluid to a fluid storage tank. Line 114 interconnects lines 96 and 112 and includes relief valve 116 which may be set at 3200 psi. As described, the control panel controls the operation of device 10.

Figure 4B:
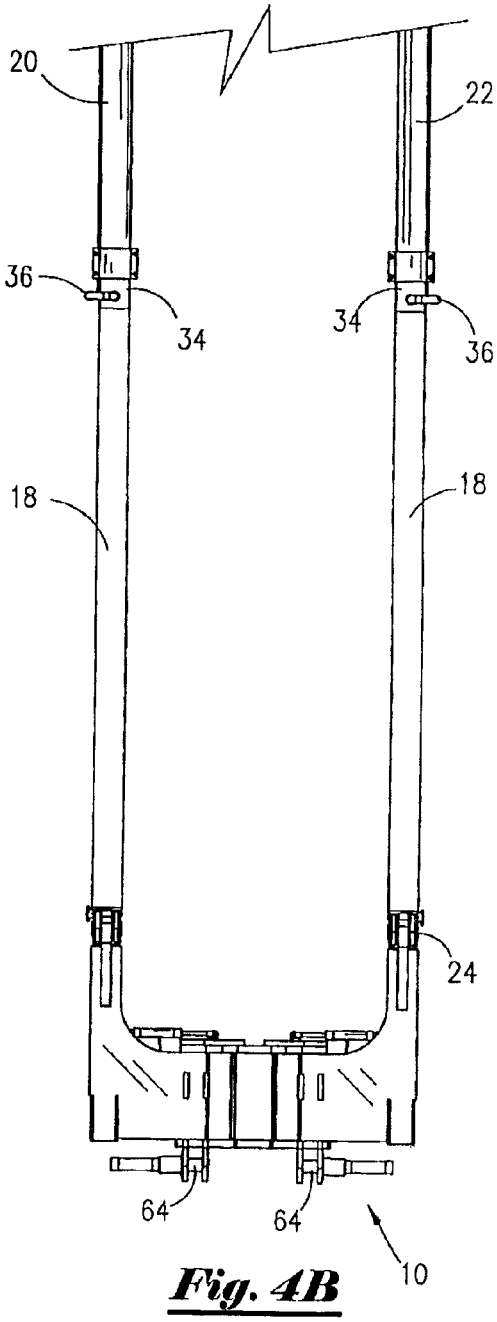

Well intervention devices such as coiled tubing injector heads, blow-out preventer stacks, and lubricators may be affixed to device 10. To maintain the well intervention devices at a fixed vertical position, compensating cylinders 20, 22 may be activated to adjust for the rise and fall of the sea or ocean surface. When the sea or ocean surface rises, cylinders 20, 22 are placed in a more contracted position to maintain the vertical position of the well intervention device. When the sea or ocean surface falls, cylinders 20, 22 are placed in a more extended position to maintain the vertical position of the well intervention device. FIGS. 4A and 4B show device 10 in an extended position.

While preferred embodiments of the present invention have been described, it is to be understood that the embodiment's described are illustrative only and that the scope of the invention is to be defined solely by the appended claims when accorded a full range of equivalents, many variations and modifications naturally occurring to those skilled in the art from a perusal hereof.

What is claimed is:

1. A motion compensating apparatus for use with a floating platform, comprising:

a downward facing, U-shaped upper frame having opposing, spaced apart side walls, each side wall having a distal end with an opening formed between the opposing distal ends of the side walls;

a downward facing, U-shaped lower frame having opposing, spaced apart legs, each leg having a distal end with an opening formed between the opposing distal ends of the legs;

a compensation cylinder detachably affixed to said lower frame and arranged for coaxially translating said lower frame with respect to said upper frame;

a capturing assembly pivotally coupled to at least one of the legs of said lower frame and arranged for carrying an intervention tool;

wherein said lower frame is slidingly captured by said upper frame independently of said compensation cylinder and said compensation cylinder is extendable and retractable with the retraction and extension of the lower frame relative to the upper frame so as to maintain a vertical position of said intervention tool with respect to a well despite heaving of said floating platform.

2. A motion compensating apparatus as defined in claim 1, wherein:

said capturing assembly pivotally coupled to the lower frame is pivotally attached to the distal end of each of the legs and can be articulated relative the lower frame.

3. A motion compensating apparatus as defined in claim 1, wherein:

the upper frame is adapted to connect to an elevator assembly of the floating platform.

4. A motion compensating apparatus as defined in claim 1, wherein:

the side walls of the upper frame house at least a portion of the compensation cylinder.

5. A motion compensating apparatus as defined in claim 1, wherein:

the upper frame includes a stop adapted to limit retraction of the compensation cylinder.

6. A motion compensating apparatus as defined in claim 5, wherein:

said stop includes a safety pin.

7. A motion compensating apparatus as defined in claim 1, wherein:

the compensation cylinder includes a distal end, which distal end is attached to one of the spaced apart lower frame legs.

8. A motion compensating apparatus as defined in claim 1, further comprising:

a circuit adapted to activate the compensation cylinder assembly.

9. A motion compensating apparatus as defined in claim 8, wherein:

said circuit is fluidal and includes a conduit for transmitting fluid to the compensation cylinder.

10. A motion compensating apparatus as defined in claim 1, further comprising:

a mechanism adapted to prevent articulation of the capturing assembly.

11. A motion compensating apparatus as defined in claim 10, wherein:

said mechanism includes a pin removably coupled between said lower frame and the capturing assembly.

12. A motion compensating apparatus as defined in claim 1, wherein:

the capturing assembly includes a retaining door having an adjustable opening for receiving a lift joint associated with the intervention tool, the retaining door capable of opening to receive or release the lift joint or closing to grip and support the lift joint.

13. A motion compensating apparatus as defined in claim 12, wherein:

the capturing assembly further includes one or more bail pins for supporting a bail.

14. A motion compensating apparatus as defined in claim 13, wherein:

the one or more bail pins are actuating bail pins.

15. A motion compensating apparatus as defined in claim 1, further comprising:

a speed control valve that limits a travel velocity of the compensation cylinder.

16. A motion compensating apparatus as defined in claim 1, further comprising:

a winch carried by said lower frame adjacent a proximal end of the opposing legs.

17. A motion compensating apparatus as defined in claim 1 further comprising:

a lock disposed between said upper and lower frames for selectively fixing said lower frame to said upper frame independently of said compensation cylinder.

18. A motion compensating apparatus as defined in claim 17, wherein:

said lock includes a removable pin.

19. A motion compensating apparatus as defined in claim 1, further comprising:

a control panel utilized to operate the motion compensating apparatus.

20. A method of maintaining a vertical position of well intervention equipment utilized with a floating platform, comprising the steps of:

(a) providing a motion compensating apparatus having a downward facing, U-shaped upper frame having opposing, spaced apart side walls, each side wall having a distal end with an opening formed between the opposing distal ends of the side walls, a downward facing, U-shaped lower frame having opposing, spaced apart legs, each leg having a distal end with an opening formed between the opposing distal ends of the legs, the lower frame coaxially slidingly translatable with respect to and directly captured by said upper frame, a compensation cylinder detachably affixed to the lower frame and arranged to extend and retract with the retraction and extension of said lower frame with respect to said upper frame, and a capturing assembly pivotally coupled to the distal end of at least one of the legs of said lower frame and capable of supporting said well intervention equipment;

(b) suspending the motion compensating apparatus from a derrick on said platform;

(c) suspending said well intervention equipment from said capturing assembly; and (d) compensating for heave by extending and retracting said compensation cylinder with the lower frame relative to the upper frame to maintain a vertical position of the well intervention equipment with respect to a well.

21. A method as defined in claim 20, further comprising the steps of:

disposing a winch on said lower frame; and utilizing the winch to hoist and position the well intervention equipment; and thereafter, pivoting the capturing assembly into engagement with the well intervention equipment.

22. A method as defined in claim 20, further comprising the steps of:

attaching a lift joint to said well intervention equipment; and carrying said lift joint by said capturing assembly.

23. A method as defined in claim 20, further comprising the steps of:

connecting a lift sub to said upper frame; and carrying said lift sub by an elevator assembly of said derrick.

24. A method as defined in claim 20, further comprising the step of:

providing a stop adapted to limit retraction of the compensation cylinder.

25. A method as defined in claim 20, further comprising the step of:

providing a stop adapted to limit extension of the compensation cylinder.

26. A method as defined in claim 20, further comprising the step of:

selectively allowing articulation the capturing assembly with respect to said lower frame.

27. A method as defined in claim 26, further comprising the step of:

removably pinning the lower frame to the capturing assembly.

28. A method as defined in claim 22, further comprising the steps of:

providing the capturing assembly with a retaining door having an adjustable opening for receiving a lift joint for the well intervention equipment;

opening the adjustable opening to receive the lift joint; and closing the adjustable opening to grip and support the lift joint.

29. A method as defined in claim 20, further comprising the step of:

providing the capturing assembly with one or more actuating bail pins for supporting a bail.

* * * * *